US007586063B1

(12) United States Patent
Wilbon

(10) Patent No.: US 7,586,063 B1
(45) Date of Patent: Sep. 8, 2009

(54) FLAMELESS LIGHTER

(76) Inventor: Thomas R. Wilbon, 1669 E. 6th St., Stockton, CA (US) 95206

( * ) Notice: Subject to any disclaimer, the term of this patent is extended or adjusted under 35 U.S.C. 154(b) by 374 days.

(21) Appl. No.: 11/537,981

(22) Filed: Oct. 2, 2006

(51) Int. Cl.
*F23Q 7/00* (2006.01)

(52) U.S. Cl. ..... 219/268; 219/260

(58) Field of Classification Search ..... 219/268, 219/260, 261, 263, 264, 265, 266, 267, 269, 219/270
See application file for complete search history.

(56) References Cited

U.S. PATENT DOCUMENTS

| | | | | |
|---|---|---|---|---|
| 2,032,695 | A * | 3/1936 | Gimera et al. | 431/151 |
| 3,392,265 | A | 7/1968 | King et al. | |
| 3,563,682 | A | 2/1971 | Bross | |
| 4,152,109 | A * | 5/1979 | Schaffer | 431/253 |
| 4,429,212 | A | 1/1984 | Mock, Jr. et al. | |
| 4,709,176 | A | 11/1987 | Ridley et al. | |
| 5,354,968 | A | 10/1994 | Yamamura | |
| D364,245 | S | 11/1995 | Anderson | |
| 5,975,714 | A | 11/1999 | Veterino et al. | |
| 6,794,613 | B1 | 9/2004 | Krumholz | |
| 2003/0226837 | A1 * | 12/2003 | Blake et al. | 219/260 |
| 2005/0218137 | A1 * | 10/2005 | Sela et al. | 219/262 |
| 2007/0045276 | A1 * | 3/2007 | Fisher et al. | 219/268 |

* cited by examiner

*Primary Examiner*—Daniel L Robinson

(57) ABSTRACT

A flameless lighter that provides a cigarette lighter that does not rely on butane or another flammable fuel. The lighter includes a battery-powered unit that includes a heating element instead of an open flame. An incorporated main body portion encloses circuitry and batteries, while on top of the main body portion is located a concentric pattern of wire with a ceramic filament. An attached cover would protect the user from unintentional contact with the hot filament while also acting as an off switch when the flameless lighter is not in use.

6 Claims, 2 Drawing Sheets

FLAMELESS LIGHTER

BACKGROUND OF THE INVENTION

The present invention concerns that of a new and improved flameless lighter that provides a cigarette lighter that does not rely on butane or another flammable fuel.

DESCRIPTION OF THE PRIOR ART

U.S. Pat. No. 6,794,613, issued to Krumholz, discloses a lighter assembly for use in a receptacle.

U.S. Pat. No. 3,563,682, issued to Bross, discloses a pressure-actuated pocket lighter.

U.S. Pat. No. 5,354,968, issued to Yamamura, discloses a battery powered electric cigarette lighter.

U.S. Pat. No. 3,392,265, issued to King, discloses a hand held cigarette lighter with a hollow enclosure housing an electric power source.

U.S. Pat. No. 4,429,212, issued to Mock, Jr., et al., discloses an ignition device for tobacco associated items such as cigars and cigarettes.

SUMMARY OF THE INVENTION

The present invention concerns that of a new and improved flameless lighter that provides a cigarette lighter that does not rely on butane or another flammable fuel. The lighter includes a battery-powered unit that includes a heating element instead of an open flame. An incorporated main body portion encloses circuitry and batteries, while on top of the main body portion is located a concentric pattern of wire with a ceramic filament. An attached cover would protect the user from unintentional contact with the hot filament while also acting as an off switch when the flameless lighter is not in use.

There has thus been outlined, rather broadly, the more important features of a flameless lighter that the detailed description thereof that follows may be better understood and in order that the present contribution to the art may be better appreciated. There are, of course, additional features of the flameless lighter that will be described hereinafter and which will form the subject matter of the claims appended hereto.

In this respect, before explaining at least one embodiment of the flameless lighter in detail, it is to be understood that the flameless lighter is not limited in its application to the details of construction and to the arrangements of the components set forth in the following description or illustrated in the drawings. The flameless lighter is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present flameless lighter. It is important, therefore, that the claims be regarded as including such equivalent constructions insofar as they do not depart from the spirit and scope of the present invention.

It is therefore an object of the present invention to provide a flameless lighter which has all of the advantages of the prior art and none of the disadvantages.

It is another object of the present invention to provide a flameless lighter which may be easily and efficiently manufactured and marketed.

It is another object of the present invention to provide a flameless lighter which is of durable and reliable construction.

It is yet another object of the present invention to provide a flameless lighter which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 2:
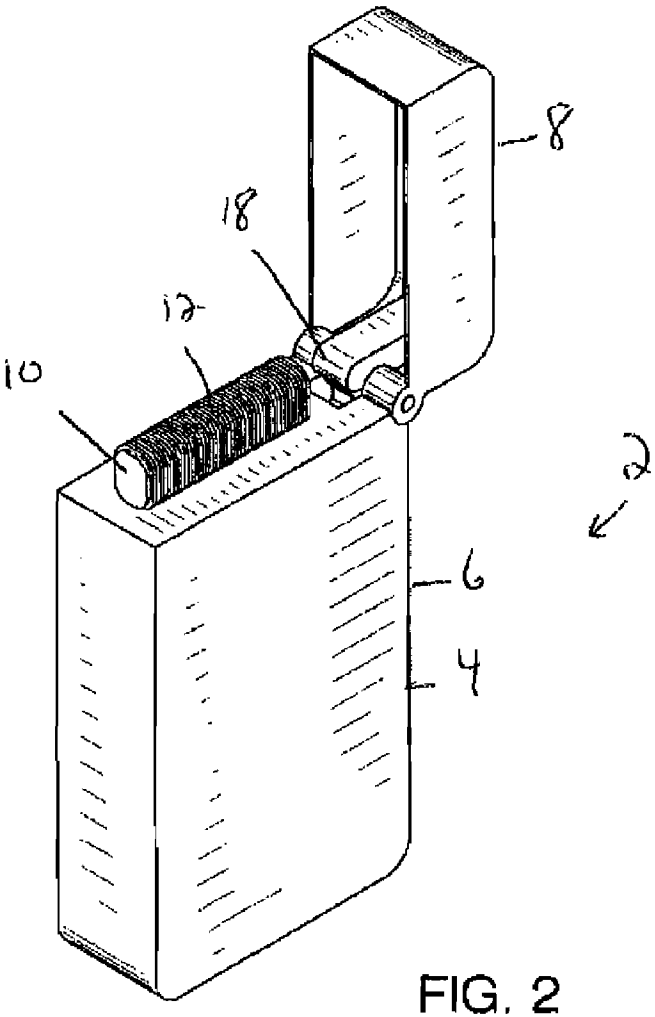
FIG. 2 shows a perspective view of the flameless lighter as it would appear with its cap open, ready for use.
Figure 1:
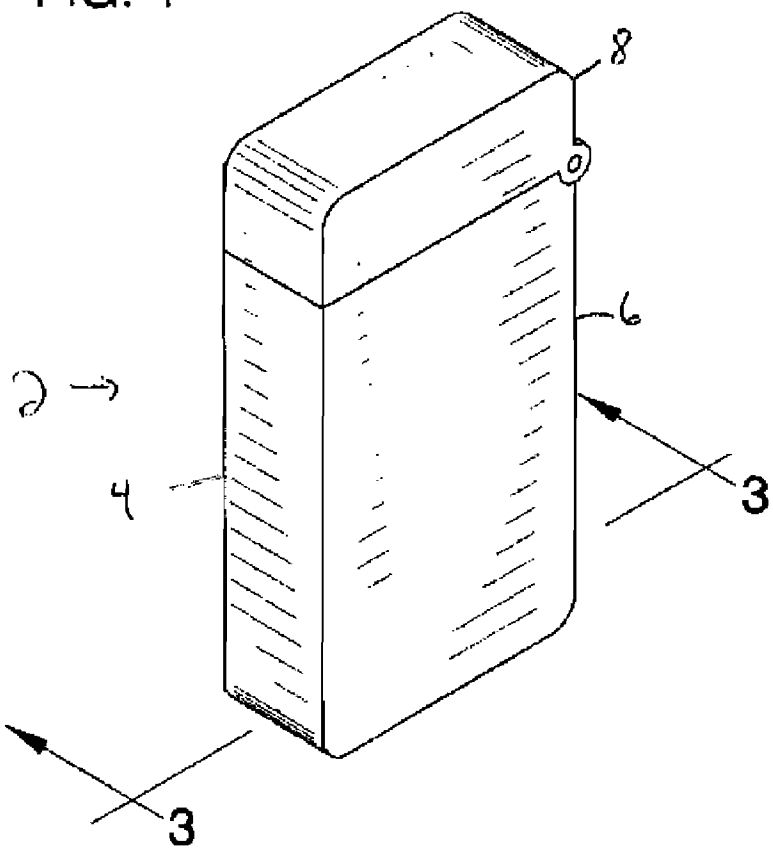
FIG. 1 shows a perspective view of the flameless lighter as it would appear with its cap closed.

With reference now to the drawings, and in particular to FIGS. 1 through 4 thereof, a new flameless lighter embodying the principles and concepts of the present invention and generally designated by the reference numeral 2 will be described.

As best illustrated in FIGS. 1 through 4, the flameless lighter 2 comprises an outer casing 4, with the outer casing 4 comprising a main body portion 6. The outer casing 4 can have a variety of shapes but is preferably box-like or rectangular in shape. A top-mounted cover 8 is pivotally attached to the main body portion 6 and has two positions comprising an open position and a closed position.

The main body portion 6 of the outer casing 4 houses a kinetic generator 14 and at least one battery 16. The kinetic generator 14 is electronically connected to the battery 16, which preferably is rechargeable. The kinetic generator 14 is designed to produce electricity when it is shaken, with this electricity being used to charge the battery 16. Therefore, the battery 16 is not designed to be replaceable.

The lighter 2 also comprises a ceramic core 10 that is covered by a heating coil 12, with the heating coil 12 designed to wrap around the ceramic core a number of times. The heating coil 12 is also attached to the battery 16 through a positive connector 30 and a negative connector 32 and will heat up under certain conditions to the point where a cigarette or other object placed against the heating coil 12 will ignite. The positive connector 30 and negative connector 32 each have two ends, a first end and a second end, with the first end of each connector being connected to the battery 16 and the second end of each connector being connected to the heating coil 12. The ceramic core 14 will serve as a mount for the heating coil 12 and will also absorb the heat generated by the heating coil 12 so it will not spread to other components of the lighter 2 and potentially burn an individual.

The battery 16 is also connected to the kinetic generator 14 by a positive connector 40 and a negative connector 42. The positive connector 40 and negative connector 42 each have two ends, a first end and a second end, with the first end of each connector being connected to the battery 16 and the second end of each connector being connected to the kinetic generator 14.

Figure 4:
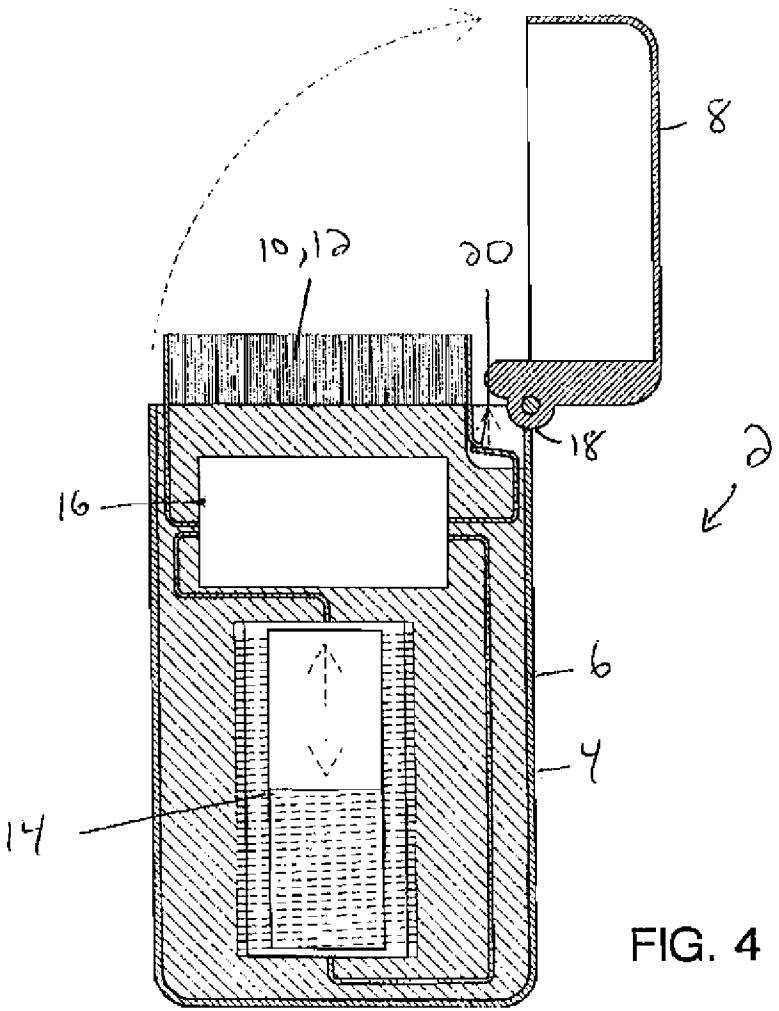
FIG. 4 shows a side cutaway view of the flameless lighter as it would appear with its cap open, ready for use.
Figure 3:
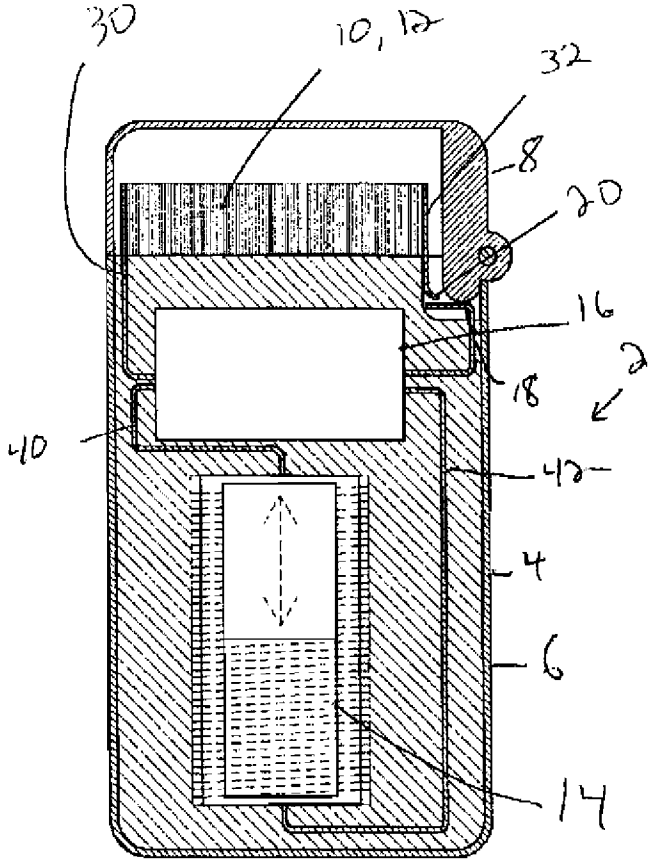
FIG. 3 shows a side cutaway view of the flameless lighter as it would appear with its cap closed.

A switch 20 is located in between the battery 16 and the heating coil 12 on either the positive connection 30 or negative connection 32, but in FIG. 4, it is shown to be on the negative connection. When the cover 8 is in a closed position, a nodule 18 that is attached to the cover 8 pushes against the switch 20, thereby placing the switch 20 in an open position. As a result, the heating coil 12 does not receive power from the battery 16 and it will not function. When the cover 8 is placed in a completely open position, the nodule 18 disengages from the switch 20, allowing the switch 20 to revert into a closed position. In this instance, the heating coil 12 is then capable of receiving power from the battery 16. Providing the battery 16 either has its own charge within it or is charged by shaking the lighter 2, which activates the kinetic generator 14, the battery 16 will then heat up the heating coil 12.

When an individual wants to use the lighter 2, he or she would open up the cover 8 and then shake the lighter 2, which would activate the kinetic generator 14. Any power within the battery 16 and any extra power generated by the kinetic generator 14 that is then used to charge up the battery 16 will be used to heat up the heating coil 12, which an individual will then be able to use to light a cigarette or other material as desired. Once the heating coil 12 has served its intended purpose, the individual may close the cover 8, which will cut power from the battery 16 to the heating coil 12, thereby allowing it to cool down. The cover 8 will allow an individual to put away the lighter 2 right away, as it will protect the individual from being placed into direct contact with the heating coil 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A flameless lighter comprising:

an outer casing, the outer casing including a main body, a top-mounted cover pivotally attached to the main body, a heating element located on the outer casing, the heating element being covered by the top-mounted cover when the top-mounted cover is in a closed position, power means for providing power to the heating element, means for connecting the power means to the heating element, means for controlling the flow of power between the heating element and the power means, wherein the power means for providing power to the heating element further comprises a battery, the battery being located within the outer casing, wherein the battery comprises a rechargeable battery, wherein the flameless lighter further comprises a charging device for charging up the battery, and means for connecting the charging device to the battery, wherein the charging device further comprises a kinetic generator, the kinetic generator being located within the outer casing.

2. A flameless lighter according to claim 1 wherein the kinetic generator located within the outer casing is a shakable kinetic generator.

3. A flameless lighter according to claim 1 wherein the means for connecting the charging device to the battery further comprises:

(a) a first positive connector having two ends, a first end and a second end, (b) a first negative connector having two ends, a first end and a second end, (c) wherein the first end of the first positive connector is attached to the battery, (d) further wherein second end of the first positive connector is attached to the charging device, (e) wherein the first end of the first negative connector is attached to the battery, (f) further wherein second end of the first negative connector is attached to the charging device.

4. A flameless lighter according to claim 3 wherein the heating element located on the outer casing further comprises:

(a) a ceramic core located on the outer casing, and (b) a heating coil wrapped around the ceramic core.

5. A flameless lighter according to claim 4 wherein the means for connecting the power means to the heating element further comprises:

(a) a second positive connector having two ends, a first end and a second end, (b) a second negative connector having two ends, a first end and a second end, (c) wherein the first end of the second positive connector is attached to the battery, (d) further wherein the second end of the second positive connector is attached to the heating element, (e) wherein the first end of the second negative connector is attached to the battery, (f) further wherein the second end of the second negative connector is attached to the heating element.

6. A flameless lighter according to claim 5 wherein the means for controlling the flow of power between the heating element and the power means further comprises:

(a) a switch located on a second connector, the switch having two positions comprising an open position and a closed position, (b) a nodule attached to the top-mounted cover, (c) wherein the nodule is placed into contact with the switch when the cover is in a closed position, thereby placing the switch in an open position, thereby preventing power from the battery from reaching the heating element, and (d) further wherein the nodule is removed from contact with the switch when the cover is in an open position, thereby allowing power from the battery to reach the heating element.

* * * * *